US005279403A

United States Patent [19]

Harbaugh et al.

[11] Patent Number: 5,279,403

[45] Date of Patent: Jan. 18, 1994

[54] MICROWAVE SECURITY THREAD DETECTOR

[75] Inventors: Steven K. Harbaugh, Castro Valley, Calif.; Timothy T. Crane, Windsor, Mass.

[73] Assignee: Crane & Company, Inc., Dalton, Mass.

[21] Appl. No.: 917,367

[22] Filed: Jul. 23, 1992

[51] Int. Cl.[5] ..... G07D 7/00

[52] U.S. Cl. ..... 194/207; 324/637

[58] Field of Search ..... 194/206, 207; 209/534; 902/7; 324/637, 639

[56] References Cited

U.S. PATENT DOCUMENTS

| | | | |
|---|---|---|---|
| 3,426,879 | 2/1969 | Walker | 194/207 |
| 4,056,731 | 11/1977 | Bayha . | |
| 4,234,844 | 11/1980 | Yukl . | |
| 4,255,652 | 3/1981 | Weber . | |
| 4,536,709 | 8/1985 | Ishida | 194/206 X |
| 4,609,207 | 9/1986 | Muck et al. . | |
| 4,639,669 | 1/1987 | Howard et al. . | |
| 4,820,912 | 4/1989 | Samyn | 324/637 X |
| 4,889,220 | 12/1989 | Yoshinori et al. | 194/206 |
| 4,980,569 | 12/1990 | Crane et al. | 250/556 |
| 5,096,038 | 3/1992 | Potter | 209/534 X |

FOREIGN PATENT DOCUMENTS

| | | | |
|---|---|---|---|
| 0060392 | 9/1982 | European Pat. Off. | 194/206 |
| 0092691 | 11/1983 | European Pat. Off. | 194/207 |
| 0413534 | 2/1991 | European Pat. Off. | 194/206 |
| 62-259047 | 11/1987 | Japan | 324/639 |
| 1281986A | 1/1987 | U.S.S.R. | 324/639 |

*Primary Examiner*—F. J. Bartuska

*Attorney, Agent, or Firm*—Richard H. Kosakowski

[57] ABSTRACT

A security thread detector for verifying the authenticity of banknotes. In the preferred embodiment, the invention comprises a housing with a passage through which banknotes can be passed, wherein the housing also comprises a waveguide, a microwave oscillator for generating microwaves and two resonating slots on a wall of the waveguide, and a microwave detector. After a banknote is inserted through the passageway, the microwave diode produces an analog signal that is proportional to the microwave strength. The diode and the slots are arranged such that the radiated power from each slot is one hundred eighty degrees out-of-phase. If a banknote has no security thread, then the detector receives a balanced signal. If the banknote contains a security thread, the thread interferes with one of the radiating slots. This interference causes an imbalance condition and a corresponding signal is sent from the detector diode. The resulting signal is then sent to a microprocessor which activates an appropriate indicator. This indicator notifies the user of the presence or absence of a security thread; thus, the user can determine whether the banknote is counterfeit.

20 Claims, 5 Drawing Sheets

MICROWAVE SECURITY THREAD DETECTOR

BACKGROUND OF THE INVENTION

This invention relates to devices used to authenticate currency. More particularly, it relates to verification machines that detect security threads embedded in currency.

The use of security threads embedded in currency paper has increased due to the advent of high-resolution, true-color photocopying machines. If modern currency does not have an embedded security thread, the currency can be more easily duplicated with a color photocopier. When the security thread is embedded, it is harder to illicitly reproduce. Unfortunately, it is also harder to verify by visual inspection. Consequently, various detectors have been invented.

One such security thread verification device is described in U.S. Pat. No. 4,980,569 to Crane et al. This detector and others similar to it require the measurement of the thread properties in the presence of the printed currency paper. The physical properties of the security thread are different than the physical properties of the paper, yet they are difficult to measure due to the interference produced by the surrounding ink.

Detectors in the past have often included capacitors. Unfortunately, these devices are not as successful as originally anticipated. With these capacitor devices, the sensor has to come in contact with the paper immediate to the thread. If the sensor does not come into contact with the paper immediate to the thread, the sensor's ability to detect the thread is reduced, and sometimes nullified. Consequently, to ensure that the thread comes into contact with the sensor, the user or transport is forced to accurately place the currency through the detector. If the user or transport inaccurately places the currency such that the thread does not come into contact with the sensor, the detector does not detect the thread; therefore, it designates the currency as counterfeit. In addition, these capacitance devices are typically very slow in authenticating the presence or absence of the thread. This is undesirable in commercial situations where the processing of large numbers of bills must be done at high rates of speed.

Accordingly, it is the primary object of the present invention to provide an improved security thread detector.

It is a general object to provide a security thread detector that is not affected by a user's or transport's inaccurate placement of the thread within the device.

It is yet another object to provide a detector that works without the need of a sensor coming into contact with the paper immediate to the security thread.

It is still another object to provide a detector that can determine a banknote's authenticity at very fast rates.

It is still a further object to provide a detector that is not hampered by the presence of ink, soil, or general degradation that occurs to currency in circulation.

The above and other objects and advantages of this invention will become more readily apparent when the following description is read in conjunction with the accompanying drawings.

SUMMARY OF THE INVENTION

To overcome the deficiencies of the prior art and to achieve the objects listed above, Applicant has invented a security thread detector which incorporates microwave technology. Hence, it is less affected by a sensor's proximity to a security thread.

In the preferred embodiment, the invention comprises a housing with a passageway, which allows a banknote to pass freely through the housing, a wave guide, and circuitry capable of transmitting and detecting microwaves. The waveguide comprises a microwave oscillator and two resonating slots which are machined into a wall of the waveguide. A microwave detector diode, located in the housing, is opposite the two slots. A banknote is passed through the passageway in the housing. The banknote's presence is detected by two photo sensors. These photo sensors then activate a microprocessor which, in turn, activates the microwave oscillator. The microwaves pass through the slots and are detected by the microwave detector. The microwave detector produces an analog signal that is proportional to the microwave signal strength. The microwave detector diode and the slots are arranged such that the radiated power from each slot is one hundred eighty degrees out-of-phase. When properly aligned, the detector receives a balanced signal from each radiating slot resulting in a signal null in the absence or presence of a banknote. This signal balance is maintained until the security thread interferes with one of the radiating slots. This imbalance condition causes a signal output from the microwave detector that is proportional to the imbalance. This signal is then sent to a microprocessor which activates an appropriate indicator.

BRIEF DESCRIPTION OF THE DRAWINGS

FIGS. 5–10 are detailed breakdowns or schematic diagrams of the circuitry in FIG. 4, wherein:

FIG. 5 shows a leading edge photo sensor and a trailing edge photo sensor;

FIG. 6 is a schematic of buffers which drive three indicators;

FIG. 7 shows a power control;

FIG. 8 is a schematic showing the adjustability of a threshold voltage;

FIG. 9 shows an interface connector; and

FIG. 10 shows an interface connection to external components.

DETAILED DESCRIPTION OF THE PREFERRED EMBODIMENTS

Figure 1:
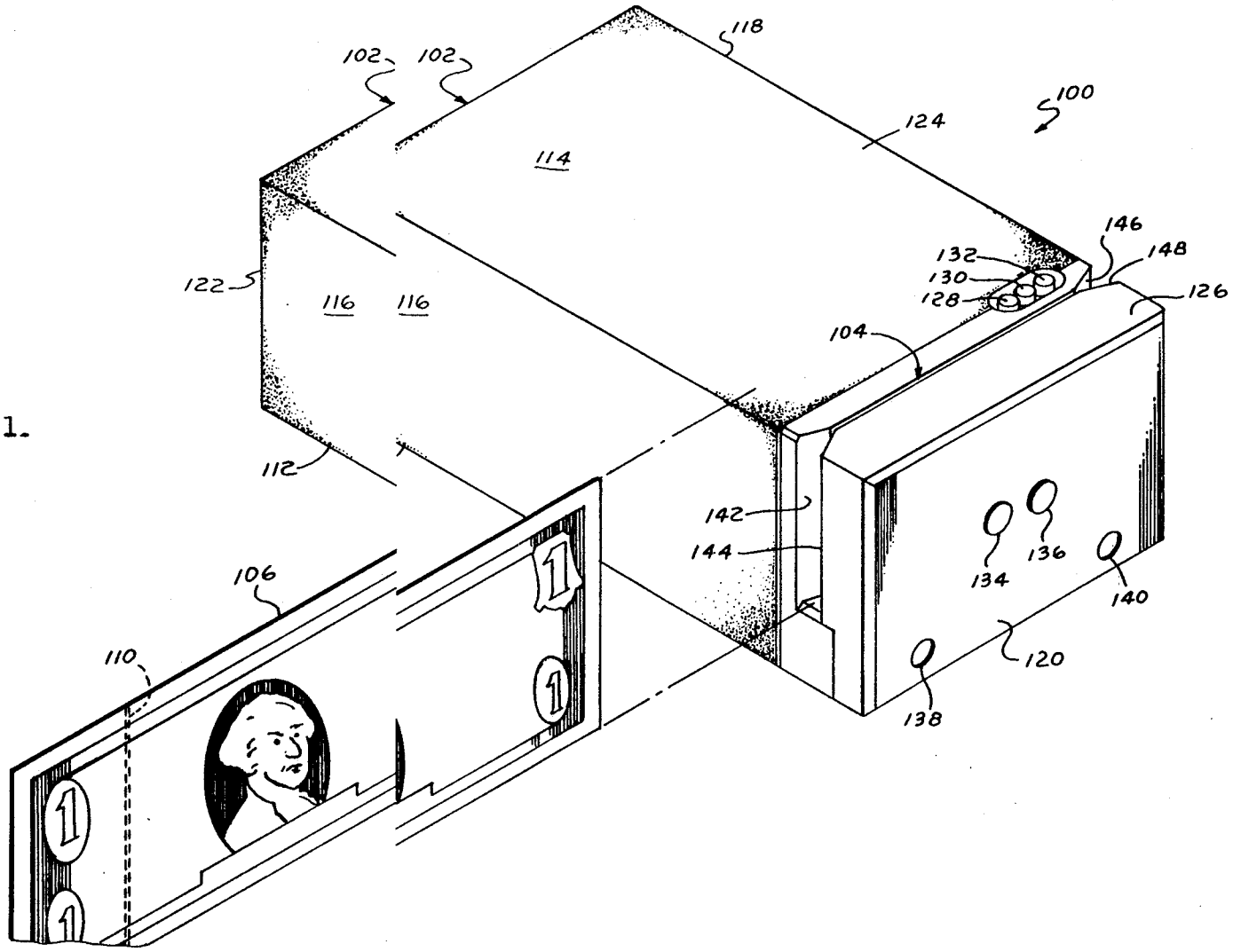
FIG. 1 is a perspective view from the top of a U.S. currency bill with an embedded security thread approaching a microwave security thread detector constructed in accordance with the present invention.

Referring to the drawings in detail, a preferred embodiment of a microwave security thread detector is shown and generally designated by the reference numeral 100. The invention basically comprises a housing 102 with a passageway 104 that extends the width of the housing 102 for passing a banknote 106 through the housing 102, and circuitry 108 within the housing 102 capable of transmitting microwaves and detecting a security thread 110 embedded within the banknote 106.

The elements of the invention have been numbered starting with 100. This has been done to eliminate any confusion between the inventive elements and the pin-numbers, which are only two-digit numbers.

Figure 2:
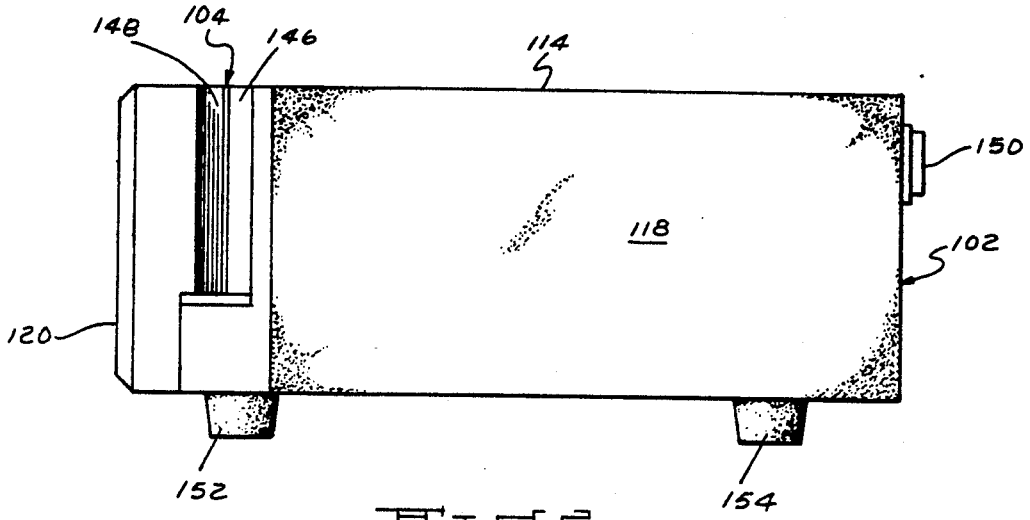
FIG. 2 is a side plan view of the detector, showing tapered side walls adjacent to a passageway.
Figure 3:
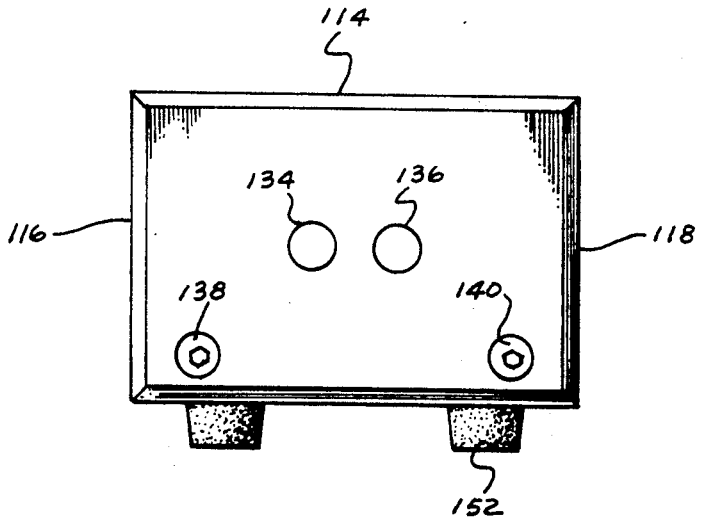
FIG. 3 is a front plan view of the detector.

The housing 102 is made of any suitable material such as aluminum. As shown in FIGS. 1-3, the housing 102 is further comprised of a base 112, a top 114, two sides 116, 118, a front panel 120, and a rear panel 122. These panels 112, 114, 116, 118, 120, 122 of the housing 102 are integrally connected at substantially right angles are held together by any suitable means such as by screws and bolts. The housing 102 can also be made of substantially one piece of suitable material.

Referring again to FIG. 1, the passageway 104 divides the top panel 114 into two asymmetrical portions 124, 126. One portion 124 has three recessed light-emitting diodes (L.E.D.s) 128, 130, 132, which are also called indicators. One indicator 128 is green; one indicator 130 is yellow; and one indicator 132 is red. These indicators can be any suitable indicators such as those manufactured and marketed by Hewlett Packard Company, of Palo Alto, Calif., Model No. HLMP-1321.

The front panel 120 has two half-spherical plastic knobs 134, 136, which are buttons snaps, as shown in FIGS. 1, 3. These knobs 134, 136 are slightly below the horizontal center of the front panel 120. These knobs 134, 136 cover holes that were machined into the housing 102 in order to wire it. The front panel 120 also contains two bolts 138, 140 in each lower corner.

The housing 102, as mentioned before, has two side panels 116, 118, shown in FIGS. 1, 2. Both side panels 116, 118 have two sloping portions which facilitate the entry or exit of a banknote 106 into the passageway 104.

The rear panel 122 of the housing 102 has an on/off switch 150, shown in FIG. 2.

The base 112 has four feet, like 152, 154, which elevate the detector 100 from the surface upon which it rests. These feet, such as 152, 154, are made of any suitable material such as rubber.

It is well known that a waveguide is a hollow metal tube that directs energy from one point to another. In a waveguide, the energy transmitted is contained in the electromagnetic fields that travel down the waveguide, and the current flow in the guide walls provides a boundary for these electric and magnetic fields.

It is also well known that, because the waveguide is hollow and filled substantially with air, it has no solid or beaded dielectric to cause dielectric losses. The dielectric loss of air is negligible at any frequency.

The frequency of the microwaves, in this case, is determined by the inner length of the waveguide. Because this waveguide is closed-, not open-ended, the waves travel the length of the cavity, hit the back panel, bounce off, and travel back in the opposite direction. The speed at which these waves travel down, bounce off, and travel back determines the frequency of the microwaves. Therefore, because the inner length of the guide, Applicants contend that the operational frequency is approximately 10.5 GHz.

CIRCUITRY OF THE SENSOR

Figure 4:
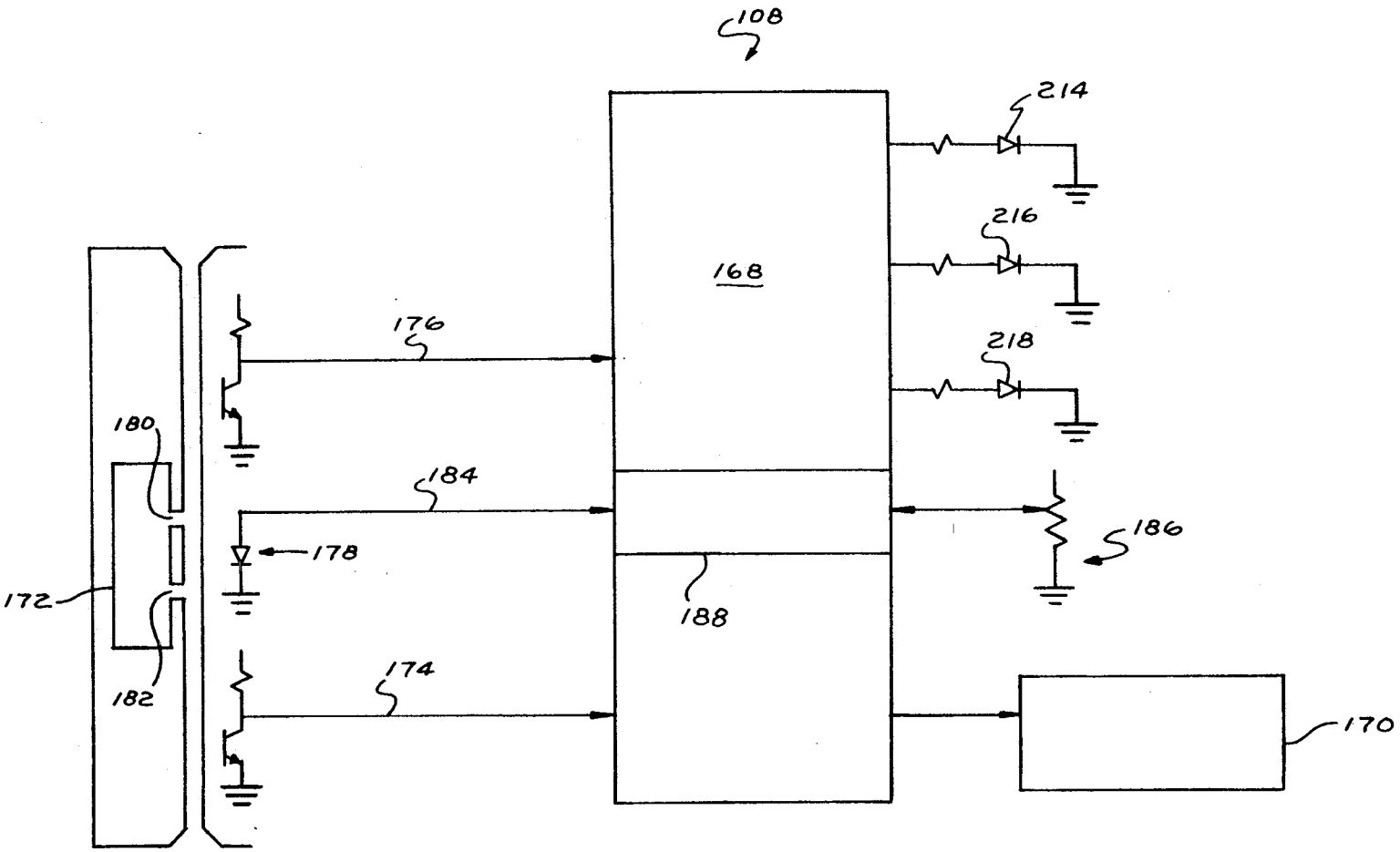
FIG. 4 is a block diagram of the detector's electrical circuitry.

Referring to FIG. 4, the illustrated embodiment for circuitry 108 of the detector 100 is shown. The circuitry 108 includes a microcontroller 168, such as the one manufactured by Vesta Technology, Inc., of Wheat Ridge, Colo., Model No. SBC196. This particular microcontroller 168 is programmed in Forth language. The microcontroller 168 detects the presence or absence of the thread 110, controls the output indicators 128, 130, 132, and activates oscillator power 170 for the microwave oscillator 172 inside the waveguide cavity. The microwave oscillator 172 includes a microwave diode (not shown) in its cavity. This oscillator 172 causes a signal to oscillate inside the cavity that is based on the cavity's dimensions.

In a preferred embodiment, the circuitry 108 also comprises two optical limit switches: a leading edge 174 and a trailing edge 176. These switches 174, 176 detect the presence of a note 106 when a note 106 is inserted into the passageway 104. These optical limit switches 174, 176 are placed on either side of a detector diode 178 so that both limits 174, 176 will detect the note 106 when the thread 110 is in proximity to the microwave detector 178.

As shown in FIG. 4, the microwave detector diode 178 is located opposite two radiating resonant slots 180, 182 machined into the waveguide. Although the detector diode 178 has been shown opposite and between the two resonant slots 180, 182, the detector 178 could be located anywhere inside the housing 102. These resonant slots 180, 182 are used to concentrate the microwave radiation in an area that matches the thread dimensions for maximum sensitivity. Using two slots 180, 182 minimizes the detector's 100 sensitivity to the currency paper 106 or other environmental effects such as temperature and frequency which are common to both slots 180, 182. The microwave detector diode 178 inside the housing is a microwave diode that produces an analog signal that is proportional to the microwave signal strength.

When properly aligned, the detector 178 receives a balanced signal from each radiating slot 180, 182 resulting in a signal null in the absence or presence of a currency note 106. This signal balance is maintained until the security thread 110 interferes with one of the two radiating slots 180, 182. This imbalanced condition results in a signal output carried along line 184 from the microwave detector 178 that is proportional to the imbalance.

The sensitivity adjustment 186 is an analog reference potentiometer which provides a threshold voltage to compare with the amplitude of the microwave detection signal. This voltage can be manually adjusted to set the thread detection sensitivity.

The analog detector signal and reference voltages are multiplexed into a ten-bit analog to digital converter 188 for processing by the microcomputer 168. The microcontroller 168 inputs the detector signal carried on line 184, reference voltage, and two optical limit switches signals 174, 176. Based upon the sequence and level of these inputs, the microcontroller 168 provides output signals which illuminate the three colored indicators 128, 130, 132 and a power controller 170 for the microwave oscillator 172.

Figure 5:
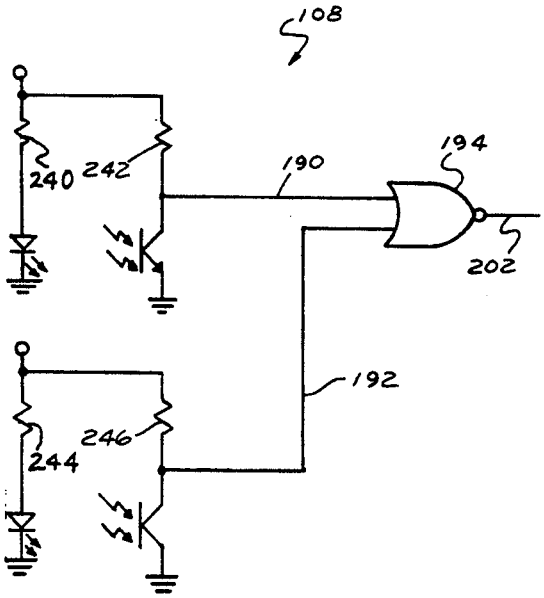
Figure 9:
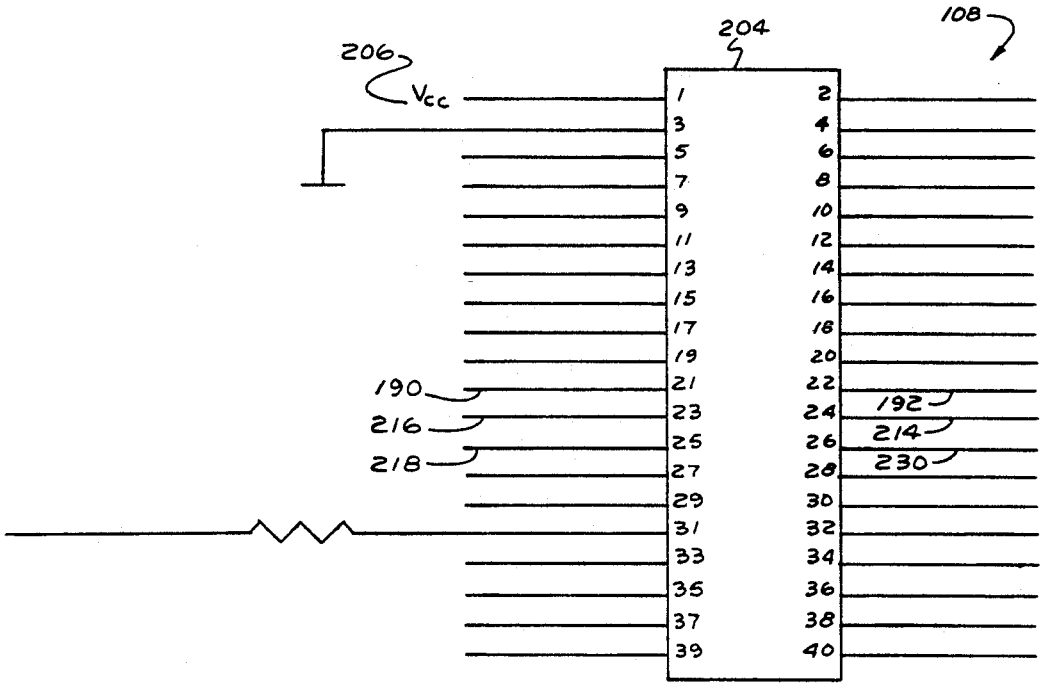

FIG. 5 is a schematic of the leading edge photo sensor 174 and the trailing edge photo sensor 176 that detect the presence or absence of the note 106. The output of the leading edge photo sensor 174 is carried along line 190 and designated as OPTO1 (Optical Detector 1). The output of the trailing edge photo sensor 176 is carried along line 192 and designated as OPTO2 (Optical Detector 2). These two outputs on lines 190, 192 are then passed through a nor gate 194. This nor gate 194, together with nor gates 196, 198, 200 shown in FIG. 6, can be any suitable nor gate, such as a quadruple two-input nor gate, manufactured by Texas Instruments, Inc., located in Dallas, Tex. The output of nor gate 194 is carried along line 202 and represented as /INIT, which is used to interrupt the microprocessor 168 from the sleep state. As shown in FIGS. 5, 9, the line 190 carrying OPTO1 and the line 192 carrying OPTO2 provide the note's presence status to the microcontroller 168 through a 40-pin ribbon connector 204. Any suitable ribbon connector will suffice. Also shown in FIG. 5 is a Vcc 206, which designates a voltage level sufficient to drive the circuit 108. In the preferred embodiment, Vcc=5 volts.

Figure 6:
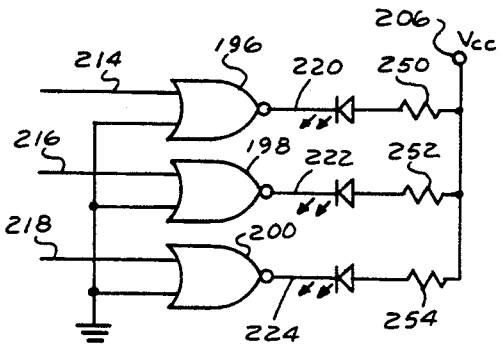

FIG. 6 is a schematic of buffers which drive the three L.E.D. indicators 128, 130, 12. One input 208, 210, 212 to each gate is ground, while the other input on line 214, designated as R.L.E.D. (red L.E.D.), on line 216, shown as Y.L.E.D. (yellow L.E.D.), and line 218 designated G.L.E.D. (green L.E.D.) may be either a voltage low or a voltage high. These inputs 208 and 214, 210 and 216, 212 and 218 then pass through nor gates 196, 198, 200. The output of nor gate 196 is carried along line 220 and designated as X7. The output of gate 198 is carried on line 222 and shown as X6. The output of gate 200 is carried on line 224 and designated as X5. The signals on lines 220, 222, 224 then pass through their corresponding L.E.D.s 128, 130, 132. These outputs, X7, X6, and X5, are shown in their corresponding locations in FIG. 10.

Figure 7:
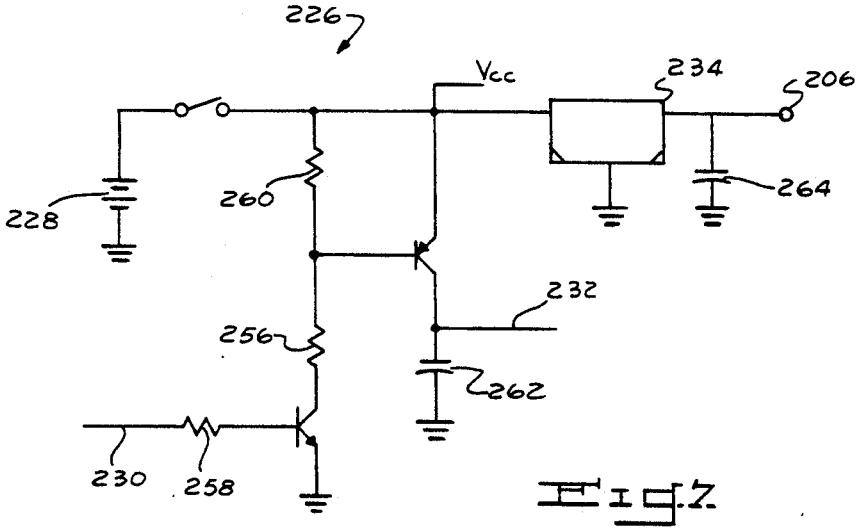

FIG. 7 shows a schematic of a power control mechanism 226. In the preferred embodiment, a nine volt battery 228 drives the circuit; however, any appropriate voltage supply can be used. When activated, a control signal, carried on line 230 and designated as /MWON is supplied by the microcontroller 168 and switches on the microwave oscillator power 170. When the microwave oscillator power 170 is on, the signal is carried along line 232 and designated as MWPWR. The power control mechanism 226 includes a voltage regulator 234. Any voltage regulator can be used, such as a five volt voltage regulator, manufactured and marketed by National Semiconductor Corporation, of Santa Clara, Calif., Model No. LM78L05.

Figure 8:
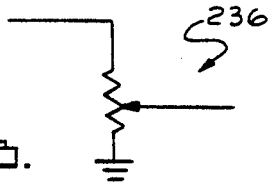

FIG. 8 depicts a potentiometer 236, which is provided to adjust the threshold voltage. This threshold voltage is input to the microcontroller 168 for adjusting the detection sensitivity.

Figure 10:
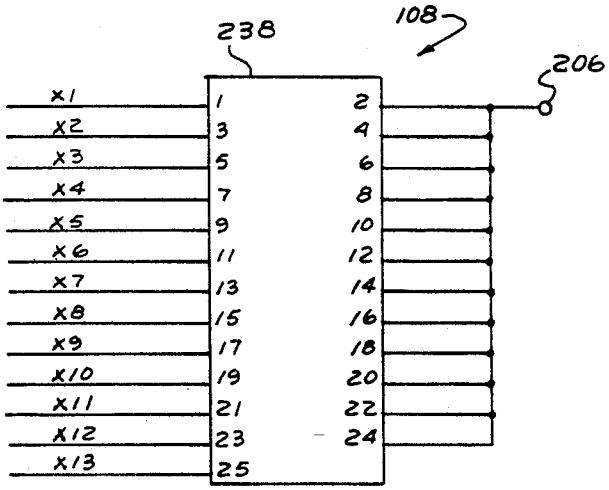

FIG. 10 shows the interface connection 238 to external components. Any suitable interface connection can be used such as a 25-pin ribbon connector, manufactured and marketed by AMP, Inc., of Harrisburg, Pa., Model No. 499487-6.

In FIGS. 5–8, any suitable resistors, variable resistors, diodes, and transistors will suffice. Typical resistors include those manufactured and marketed by Allen-Bradley Company, of Milwaukee, Wis. Typical diodes can be those manufactured and marketed by Motorola, Inc., of Albuquerque, N. Mex. Similarly, suitable transistors include those manufactured and marketed by Motorola, Inc., of Albuquerque, N. Mex.

In this embodiment, the invention uses the following resistor and capacitor values to implement the invention. These resistors and capacitors are shown in FIGS. 5–8.

| Reference No. | Resistor/ Capacitor No. | Resistance/Capacitance |
|---|---|---|
| 240 | R1 | 1.0k ohms |
| 242 | R2 | 10.0k ohms |
| 244 | R3 | 1.0k ohms |
| 246 | R4 | 10.0k ohms |
| 248 | R5 | 1.0k ohms |

-continued

| Reference No. | Resistor/ Capacitor No. | Resistance/Capacitance |
|---|---|---|
| 250 | R6 | 1.0k ohms |
| 252 | R7 | 1.0k ohms |
| 254 | R8 | 1.0k ohms |
| 256 | R9 | 5.1k ohms |
| 258 | R10 | 10.0k ohms |
| 260 | R11 | 1.0k ohms |
| 262 | C1 | 0.1 microfarads |
| 264 | C2 | 0.1 microfarads |

The security thread 110, which is embedded within the currency paper 106, has physical properties that are uniquely different from the physical properties of the paper and ink. Detecting the differences in these properties allows for detection of the presence or absence of the security thread 110. Once the thread 110 has been detected, the banknote's authenticity is verified.

It is also well known that a thin slot, machined into a waveguide that perturbs the current distribution at the surface of the waveguide will couple energy out of the waveguide. It is also well known that a radiating slot will have maximum conductivity radiation efficiency when the slot length is resonant or approximately equal to one-half of the radiating wavelength.

Consequently, a slot configuration that approaches the physical dimensions of a security thread 110 segment will provide the ability to contain the radiation within a limited area that is most sensitive to the presence or absence of the thread.

When the security thread 110 comes into close proximity to the radiating slot, the dielectric of the thread 110 changes the effective resonant length of the slot; this results in a decrease in radiated power. In addition, the aluminum printing on the thread 110 itself further decreases the radiated power by reflecting energy back into the waveguide.

Detecting this change in radiated power enables one to detect the presence of the security thread, verifying the banknote's authenticity. The microwave detector 100, monitoring the radiated power, produces a signal whose amplitude is proportional to the radiated power. When the presence of the thread 110 changes the balanced condition, the microwave signal will proportionally increase. This microwave signal, when compared to a threshold level, will indicate the presence of the thread.

In operation, a user turns on the device 100 by flipping the power switch 150 located on the rear panel 122 of the housing 102. This activates the microprocessor 168. The microprocessor 168 responds by momentarily illuminating green, yellow, and red indicators 128, 130, 132. The microprocessor 168 then goes into a power down sleep mode to conserve power.

Next, the user inserts a note 106 into the passageway 104. The leading edge 174 note detector wakes the microprocessor 168 and applies power to the microwave detector diode 178. The adjustable thread sensor 186 threshold level is read and stored by the microprocessor 168.

The microprocessor 168 waits for the second note detector 176 to guarantee that the note 106 is fully covering the microwave detector 178. While both note detectors 174, 176 indicate the presence of the note 106, the microprocessor 168 compares the continuous thread sensor signal to the threshold value recording any level which exceeds the threshold. (It should be understood that the invention could operate without either switch 174, 176. If neither switch were included, the microprocessor 168 would have to be "on" all the time.) The microwave diode 178 produces an analog signal that is proportional to the microwave signal strength. The microwave detector diode 178 and the slots 180, 182 are arranged such that the radiated power from each slot 180, 182 is one hundred eighty degrees out-of-phase. When properly aligned, the detector 178 receives a balanced signal from each radiating slot 180, 182, resulting in a signal null in the absence of a banknote 106. When a note 106 is inserted between the detector 178 and the radiating slots 180, 182, a signal balance is maintained until the security thread 110 interferes with one of the radiating slots 180, 182. This imbalance condition causes a signal output from the microwave detector 178 that is proportional to the imbalance. This signal is then sent to the microprocessor 168.

After the note 106 is removed from the detector 100, one of the three status lights 128, 130, 132 will illuminate to indicate a particular status. A green signal 128 acknowledges that the thread 110 has been detected. A yellow signal 130 indicates a sensor error. A red signal 132 indicates that the thread 110 has not been detected. Afterwards, the microprocessor 168 returns to the power down sleep mode and the microwave oscillator power 170 is turned off In its present embodiment, the banknote 106 can be passed through the passageway 104 in any direction—lengthwise, widthwise, up or down. This is unlike the previous capacitance devices, where placement of the banknote was crucial to correct verification of authenticity. Because placement of the note is less critical, the speed of verification is much higher. This feature is very important for commercial institutions, such as banks.

Applicants envision downsizing the current version by using modern computer chips. Then, the unit could be easily attached to money counting and sorting equipment or a cash register. In this alternate embodiment, the unit could be powered off the same source as the cash register or counter.

Other applications include, but are not limited to, currency transports for automated authentification equipment, automatic teller machines (ATMs), vending machines, and the like. In these other applications, the banknote will pass through a passageway automatically, not manually; usually, this is accomplished by use of a transport. Further, these other applications will not utilize a housing; they will only need a passageway for the banknote.

Further, Applicant envisions that not only can the security thread 110 be detected with microwaves, but also the currency's denomination can be sensed. This is because the presence of the metal writing (which would indicate the denomination) may produce a diffraction pattern in the radiated power whose signature will indicate the note's denomination. The difference in the spacing and sizes of the letters for each of the denominations may produce a machine recognizable pattern in the microwave radiated energy.

It should be understood by those skilled in the art that obvious structural modifications can be made without departing from the spirit of the invention. Accordingly, reference should be made primarily to the accompanying claims, rather than the foregoing specification, to determine the scope of the invention.

Having thus described the invention, what is claimed is:

1. A method of detecting the presence or absence of a security thread in a banknote which comprises:

a. sensing the presence of the banknote;

b. generating microwaves which pass through at least one resonant slot before passing through the banknote;

c. detecting the waves which pass through the banknote; and d. determining whether a security thread has interfered with any generated waves.

2. A detecting method as recited in claim 1, wherein the sensing step includes passing the note by at least one photo sensor.

3. A detecting method as recited in claim 1, wherein the generating step includes oscillating microwaves.

4. A detecting method as recited in claim 1, wherein the determining step includes monitoring the phase of the waves which pass through the resonant slot.

5. A device for verifying authenticity of currency paper and banknotes comprising:

a. a waveguide comprising a cavity;

b. a passageway in the waveguide adapted in size and shape to receive a banknote;

c. a microprocessor, said microprocessor located in a housing;

d. an oscillator, said oscillator located inside the waveguide cavity, said oscillator electronically connected to the microprocessor, wherein the oscillator generates microwaves;

e. a microwave detector, said detector located inside said housing, said detector electronically connected to the microprocessor, wherein the detector detects the wave generated by the microwave oscillator;

f. at least two resonant slots, said slots located opposite of and opposed to said oscillator and on a wall of said waveguide, wherein the generated microwaves must pass through the slots before being detected by the detector;

g. wherein the banknote passes through the passageway adjacent to said slots in the wall of the waveguide; and h. wherein the presence of a security thread interferes with the microwaves and wherein the absence of a security thread does not interfere with the microwaves.

6. The verifying device of claim 5, wherein two photo sensors are located on either side of the microwave detector and are electronically connected to the microprocessor.

7. The verifying device of claim 5, wherein the microwaves are one hundred eighty degrees out-of-phase and cancel each other causing a balanced signal to be detected by the microwave detector until a security thread interferes with these microwaves, wherein this interference causes an imbalanced signal to be detected by the microwave detector.

8. A device for verifying authenticity of currency paper and banknotes comprising:

a. a housing comprised of a top, bottom, and four opposed sidewalls and a passageway adapted in size and shape to receive a banknote, said passageway extending between two opposed sidewalls;

b. a waveguide comprising a cavity, said waveguide integrally attached to a bottom panel of said housing;

c. a microprocessor, said microprocessor located inside said housing;

d. an oscillator, said oscillator electronically connected to the microprocessor, inside the housing, wherein the oscillator generates microwaves;

e. a microwave detector, said microwave detector electronically connected to the microprocessor, wherein the detector detects the waves generated by the microwave oscillator and produces a signal indicative thereof which is electronically sent to the microprocessor;

f. at least two resonant slots, said slots located on a wall of said waveguide opposite of and opposed to the microwave detector, wherein the generated microwaves must pass through the slots before being detected by the detector;

g. wherein the banknote passes through the passageway adjacent to said slots in the wall of the waveguide; and h. wherein the presence of a security thread interferes with the microwaves and wherein the absence of a security thread does not interfere with the microwaves.

9. The verifying device of claim 8, wherein two photo sensors are located on either side of the microwave detector and are electronically connected to the microprocessor.

10. The verifying device of claim 8, wherein the microwaves are one hundred eighty degrees out-of-phase and cancel each other causing a balanced signal to be detected by the microwave detector until a security thread interferes with those microwaves, wherein this interference causes an imbalanced signal to be detected by the microwave detector.

11. The verifying device of claim 8, wherein a plurality of indicators are electronically connected to the microprocessor, wherein the microprocessor activates a first indicator when no interruption of the microwaves occurs, and wherein the microprocessor activates a second indicator when an interruption of the microwaves does occur.

12. A device for verifying authenticity of currency paper and banknotes comprising:

a. a housing comprised of a top, bottom, and four opposed sidewalls and a passageway adapted in size and shape to receive a banknote, said passageway extending between two opposed sidewalls;

b. a waveguide comprising a cavity, said waveguide integrally attached to a bottom panel of said housing;

c. at least one sensor, wherein the sensor detects the banknote's presence in the housing and generate an electrical signal indicative thereof;

d. a microprocessor, said microprocessor located inside said housing, said microprocessor electronically connected to said sensor, wherein the microprocessor receives the signal from the sensor and produces an electronic signal indicative thereof;

e. an oscillator inside the waveguide, said oscillator electronically connected to the microprocessor, wherein the oscillator generates microwaves;

f. a microwave detector, said detector electronically connected to said microprocessor, wherein the detector detects the waves generated by the microwave oscillator and produces a signal indicative thereof which is electronically sent to the microprocessor;

g. two slots, said slots located on a wall of the waveguide, wherein the waves generated by the microwave oscillator pass through the slots before being detected by the microwave detector;

h. wherein the banknote passes through the passageway and between the slot and the detector; and i. a plurality of indicators electronically connected to the microprocessor, wherein the microprocessor activates a first indicator when no interruption of the microwaves occurs, and wherein the microprocessor activates a second indicator when an interruption of the microwaves does occur.

13. The verifying device of claim 12, wherein two photo sensors are located inside said housing and are electronically connected to the microprocessor.

14. The verifying device of claim 12, wherein at least two resonant slots are opposite of and on either side of the microwave detector.

15. The verifying device of claim 14, wherein the microwaves are one hundred eighty degrees out-of-phase and cancel each other causing a balanced signal to be detected by the microwave detector until a security thread interferes with those microwaves, wherein this interference causes an imbalance signal to be detected by the microwave detector.

16. A device for verifying authenticity of banknotes and currency paper comprising:

a. a housing comprised of a top, bottom, four opposed sidewalls, and a passageway between two opposed sidewalls, adapted in size and shape to receive a banknote, for passing the banknote through the housing;

b. a waveguide comprising a cavity, said waveguide integrally attached to a bottom panel of said housing;

c. two photo sensors, wherein the sensors detect the banknote's presence in the housing and generate an electrical signal indicative thereof;

d. a microprocessor, said microprocessor located in said housing, said microprocessor electronically connected to both sensors, wherein the microprocessor receives the signals of the photo sensors and produces an electrical signal indicative thereof;

e. a microwave oscillator inside the waveguide, said oscillator electronically connected to said microprocessor, wherein the oscillator generates microwaves;

f. a first and second slot, said slots located on a wall of said waveguide, wherein the waves generated by the microwave oscillator pass through the slots;

g. a microwave detector diode, said detector electronically connected to the microprocessor, wherein the detector detects the waves generated by the microwave oscillator and produces a signal indicative thereof which is electronically sent to the microprocessor;

h. wherein the banknote passes through the passageway and adjacent to the slots on the waveguide; and i. a plurality of indicators electronically connected to the microprocessor, wherein the microprocessor activates a first indicator when no interruption of the microwaves occurs, and wherein the microprocessor activates a second indicator when an interruption of the microwaves does occur.

17. A device for verifying authenticity of banknotes and currency paper comprising:

a. a housing comprised of a top, bottom, and four opposed sidewalls and a passageway adapted in size and shape to receive a banknote, said passageway extending between two opposed sidewalls for passing a banknote through the housing;

b. a waveguide comprising a cavity, said waveguide integrally attached to a bottom panel of said housing;

c. a first detecting electronic means for detecting the presence of a banknote in the passageway and generating a signal indicative thereof;

d. a processing means for receiving the signal indicating the banknote's presence, said processing means electronically connected to first detecting means;

e. a generating means for producing microwaves, said generating means located inside said waveguide, said generating means electronically connected to processing means;

f. a second detecting means for detecting the microwaves produced by the generating means, said detecting means located inside said housing;

g. a least two resonant slots, said slots located on a wall of said waveguide, wherein the generated microwaves pass through the slots before being detected by the detecting means;

h. wherein a banknote passes through the passageway and adjacent to the slots;

i. wherein the presence of a security thread interferes with the microwaves and wherein the absence of a thread does not interfere with the microwaves; and j. wherein the presence or absence of this interference is detected by the detecting means which generates an electronic signal indicative thereof, said signal is received by the processing means.

18. The verifying device of claim 17, wherein a plurality of indicators are electronically connected to the processing means, wherein the processing means activates a first indicator when no interruption of the microwaves occurs, and wherein the processing means activates a second indicator when an interruption of the microwaves does occur.

19. The verifying device of claim 17, wherein the microwaves are one hundred eighty degrees out-of-phase and cancel each other causing a balanced signal to be detected by the second detecting means until a security thread interferes with those microwaves, wherein this interference causes an imbalanced signal to be detected by the second detecting means.

20. A method of detecting the presence or absence of a security thread embedded within a banknote, the thread having selectively metallized printing thereon, the method comprising the steps of:

a. generating microwaves that pass through at least one resonant slot before passing through the banknote, the slot having physical dimensions that direct the microwaves to propagate within an area that equals a portion of the physical dimensions of the security thread;

b. determining whether any of the microwaves have passed through the banknote; and c. determining whether the security thread has interfered with any of the microwaves.

* * * * *

UNITED STATES PATENT AND TRADEMARK OFFICE

CERTIFICATE OF CORRECTION

PATENT NO. : 5,279,403

DATED : January 18, 1994

INVENTOR(S) : Steven K. Harbaugh, et. al.

It is certified that error appears in the above-indentified patent and that said Letters Patent is hereby corrected as shown below:

Title page, item [73], Assignee: should read -- AUTHENTICATION TECHNOLOGIES, INC., DUBLIN, CALIF --.

Signed and Sealed this

Ninth Day of August, 1994

*Attest:*

*Attesting Officer*

BRUCE LEHMAN

*Commissioner of Patents and Trademarks*